US009780517B2

(12) United States Patent
Zerebilov

(10) Patent No.: US 9,780,517 B2
(45) Date of Patent: Oct. 3, 2017

(54) ELECTRICAL CONNECTOR

(71) Applicants: FCI ASIA PTE. LTD, Singapore (SG); FCI AMERICAS TECHNOLOGY LLC, Carson City, NV (US)

(72) Inventor: Arkady Y. Zerebilov, Lancaster, PA (US)

(73) Assignee: Amphenol FCI Asia Pte Ltd, Singapore (SG)

( * ) Notice: Subject to any disclaimer, the term of this patent is extended or adjusted under 35 U.S.C. 154(b) by 0 days.

(21) Appl. No.: 15/107,875

(22) PCT Filed: Dec. 16, 2014

(86) PCT No.: PCT/US2014/070501
§ 371 (c)(1),
(2) Date: Jun. 23, 2016

(87) PCT Pub. No.: WO2015/100062
PCT Pub. Date: Jul. 2, 2015

(65) Prior Publication Data

US 2016/0322770 A1 Nov. 3, 2016

Related U.S. Application Data

(60) Provisional application No. 61/920,094, filed on Dec. 23, 2013.

(51) Int. Cl.
*H01R 13/518* (2006.01)
*H01R 43/26* (2006.01)
(Continued)

(52) U.S. Cl.
CPC ..... *H01R 43/26* (2013.01); *H01R 11/09* (2013.01); *H01R 13/506* (2013.01);
(Continued)

(58) Field of Classification Search
CPC ... H01R 13/518; H01R 13/514; H01R 13/506
(Continued)

(56) References Cited

U.S. PATENT DOCUMENTS 5,184,961 A * 2/1993 Ramirez ..... H01R 13/518 439/248
6,422,876 B1 7/2002 Fitzgerald et al.
(Continued)

OTHER PUBLICATIONS

International Search Report and Written Opinion for International Application No. PCT/US2014/070501 mailed Mar. 26, 2015.
(Continued)

*Primary Examiner* — Gary Paumen
(74) *Attorney, Agent, or Firm* — Wolf, Greenfield & Sacks, P.C.

(57) ABSTRACT

First and second electrical connectors are configured to be supported by each other prior to being mated to at least one complementary electrical connector. The at least one complementary electrical connector can be a common third electrical connector. The first electrical connector can be configured to be mounted onto a first electrical component of a first type. The second electrical connector can be configured to be mounted onto a second electrical component of a second type that is different than the first type. For instance, one of the first and second electrical components can be a printed circuit board, and the other of the first and second electrical components can include a plurality of electrical cables.

28 Claims, 8 Drawing Sheets

(51) Int. Cl.

| | |
|---|---|
| ***H01R 11/09*** | (2006.01) |
| ***H01R 13/506*** | (2006.01) |
| ***H01R 13/514*** | (2006.01) |
| ***H01R 13/6587*** | (2011.01) |
| ***H01R 13/629*** | (2006.01) |
| *H01R 13/631* | (2006.01) |

(52) U.S. Cl.
CPC ..... *H01R 13/514* (2013.01); *H01R 13/629* (2013.01); *H01R 13/6587* (2013.01); *H01R 13/631* (2013.01)

(58) Field of Classification Search
USPC ..... 439/540.1, 701
See application file for complete search history.

(56) References Cited

U.S. PATENT DOCUMENTS

| | | | | |
|---|---|---|---|---|
| 7,780,471 | B2 * | 8/2010 | Hung | H01R 13/514 439/540.1 |
| 8,221,160 | B2 * | 7/2012 | Liu | H01R 13/6658 439/540.1 |
| 8,267,722 | B2 * | 9/2012 | Zhou | H01R 13/516 439/540.1 |
| 8,353,724 | B2 * | 1/2013 | Shi | H01R 13/5812 439/540.1 |
| 2001/0049223 | A1 * | 12/2001 | Fukatsu | H01R 9/2408 439/540.1 |
| 2011/0250788 | A1 * | 10/2011 | Davison | H01R 13/518 439/540.1 |
| 2012/0094512 | A1 | 4/2012 | Northey | |
| 2012/0094526 | A1 * | 4/2012 | Yin | H01R 12/52 439/540.1 |
| 2012/0129386 | A1 * | 5/2012 | Sun | H01R 13/516 439/540.1 |
| 2013/0109246 | A1 | 5/2013 | Minich et al. | |
| 2013/0196551 | A1 | 8/2013 | Minich | |
| 2013/0273781 | A1 | 10/2013 | Buck et al. | |
| 2014/0357095 | A1 * | 12/2014 | Kute | H01R 13/518 439/34 |

OTHER PUBLICATIONS

International Preliminary Report on Patentability for International Application No. PCT/US2014/070501 mailed Jul. 7, 2016.

* cited by examiner

ELECTRICAL CONNECTOR

RELATED APPLICATIONS

The present application is a U.S. national stage filing under 35 U.S.C. §371 based on International Application No. PCT/US2014/070501 entitled "ELECTRICAL CONNECTOR", filed Dec. 16, 2014, which claims priority under 35 U.S.C. §119(e) to U.S. Provisional Application Ser. No. 61/920,094, filed Dec. 23, 2013. Both of the aforesaid applications are hereby incorporated by reference herein.

BACKGROUND

Electrical connector assemblies typically include a first and second electrical connector having connector housings and a plurality of electrical contacts supported by the connector housings. The first electrical connector is configured to be mounted to a first electrical component so as to place the electrical contacts of the first electrical connector in electrical communication with the first electrical component. The second electrical connector is configured to be mounted to a second electrical component so as to place the electrical contacts of the second electrical connector in electrical communication with the second electrical component, The first and second electrical connectors can be mated to each other so as to place the electrical contacts of the first electrical connector in electrical communication with the electrical contacts of the second electrical connector. Thus, when the first and second electrical connectors are mounted to the first and second electrical components, respectively, and mated to each other, the first and second electrical components are placed in electrical communication with each other. Examples of electrical components to which electrical connectors are configured to be mounted include substrates, such as printed circuit boards, and electrical cables.

SUMMARY

In accordance with one embodiment, an electrical connector subassembly can include a first electrical connector including an electrically insulative first connector housing and a first plurality of electrical contacts supported by the first connector housing, the first plurality of electrical contacts defining respective mating ends and respective mounting ends, wherein the first electrical connector is configured to be mounted onto a first electrical component of a first type. The electrical connector subassembly can further include a second electrical connector including an electrically insulative second connector housing and a second plurality of electrical contacts supported by the second connector housing, the second plurality of electrical contacts defining respective mating ends and respective mounting ends, wherein the second electrical connector is configured to be mounted onto a second electrical component of a second type that is different than the first type. The first and second electrical connectors are configured to be supported by each other without being mated to each other prior to the first and second electrical connectors being mated with at least one complementary electrical connector. For instance, the at least one complementary electrical connector can be a common third electrical connector.

DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1A:
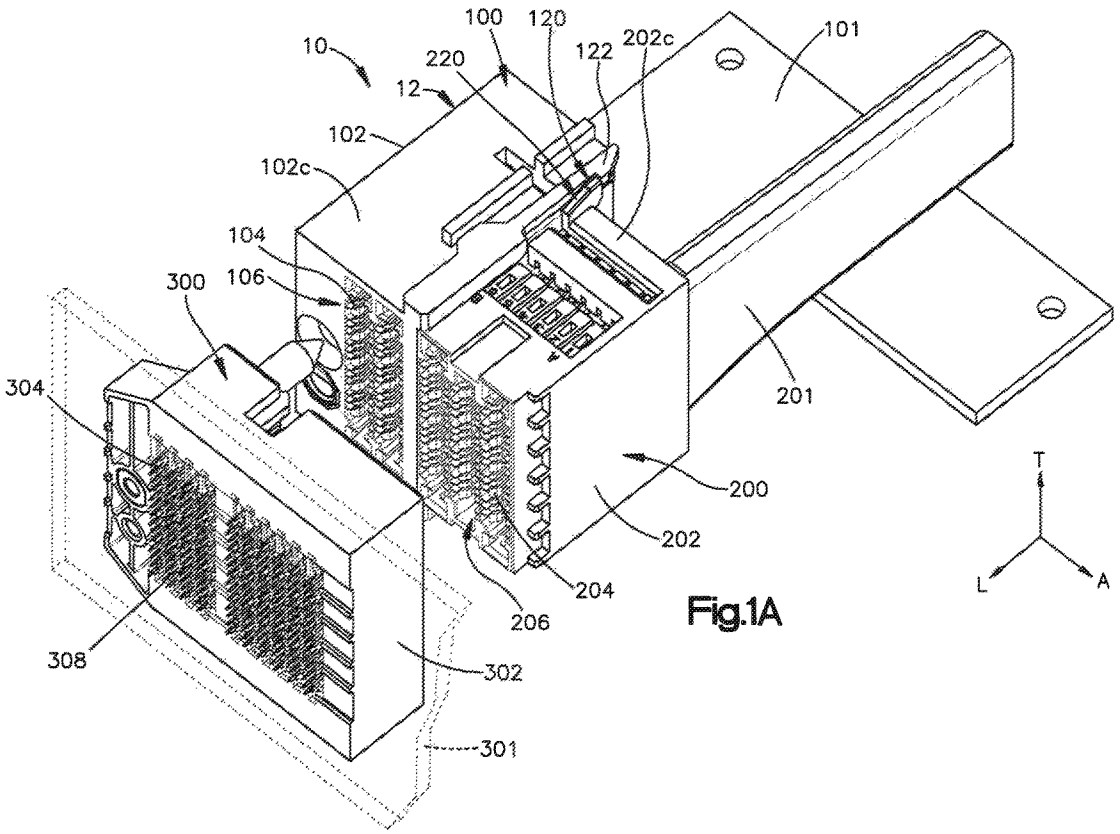
FIG. 1A is a perspective view of an electrical connector assembly in accordance with one embodiment, including first and second electrical connectors attached to each other and aligned to be mated with a common third electrical connector.
Figure 1B:
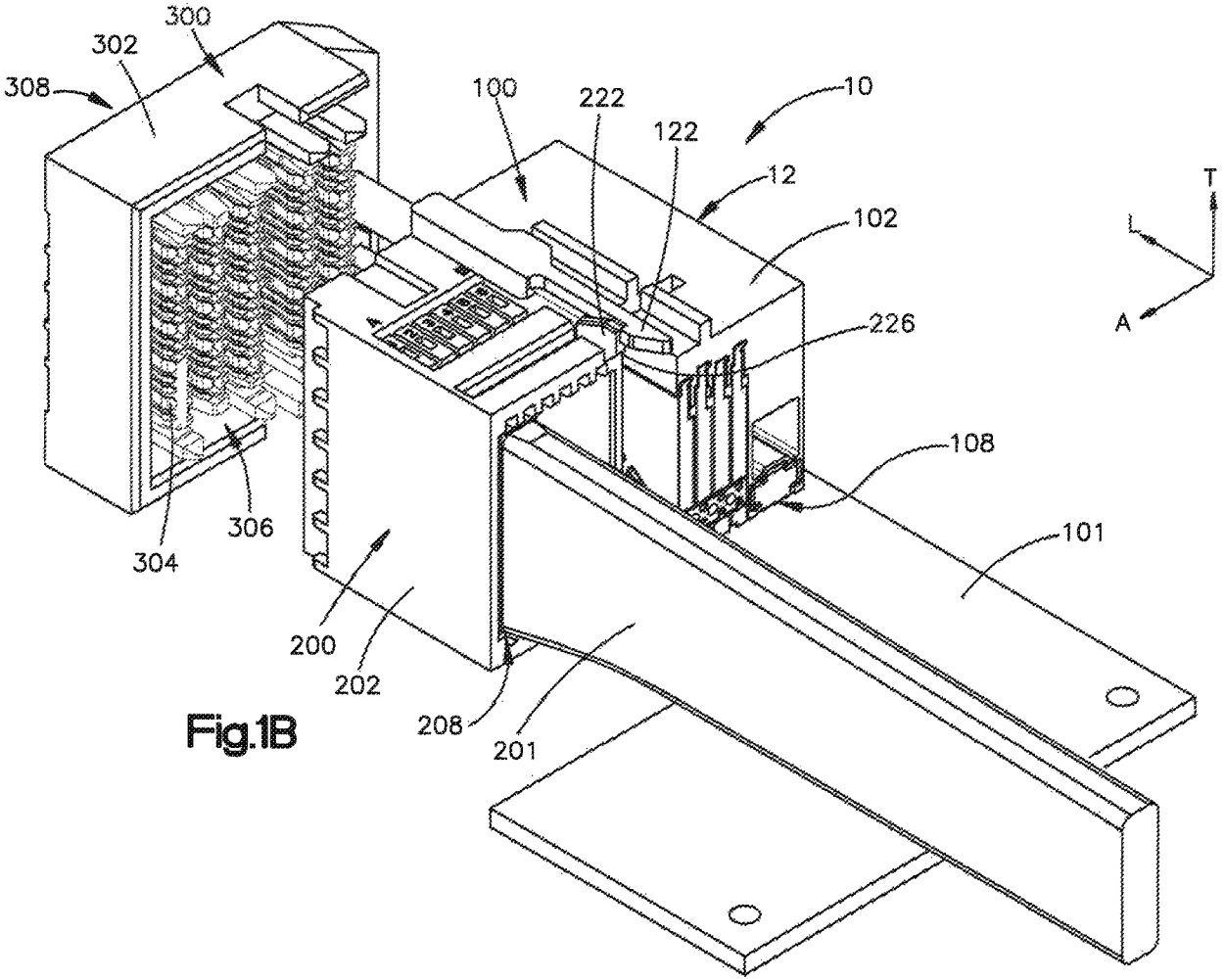
FIG. 1B is another perspective view of the electrical connector assembly shown in FIG. 1A.

Referring initially to FIGS. 1A and 1B, an electrical connector assembly 10 can be configured as described in be configured as described in U.S. Patent Application Publication No. 2013/0273781, published Oct. 17, 2013, the disclosure of which is hereby incorporated by reference as if set forth in its entirety herein, unless otherwise indicated. In accordance with one embodiment the electrical connector assembly 10 can include a first electrical connector 100 and a respective first electrical component 101, a second electrical connector 200 and a respective second electrical component 201, and a third electrical connector 300 and a respective third electrical component 301. The first electrical connector 100 includes a dielectric or electrically insulative first connector housing 102 and a first plurality of electrical contacts 104 supported by the first connector housing 102. The second electrical connector 200 includes a dielectric or electrically insulative second connector housing 202 and a second plurality of electrical contacts 204 supported by the second connector housing 202. The third electrical connector 300 includes a dielectric or electrically insulative third connector housing 302 and a third plurality of electrical contacts 304 supported by the third connector housing 302. The first electrical connector 100 is configured to be mounted to the first electrical component 101 so as to place the first electrical contacts 104 in electrical communication with the first electrical component 101. The second electrical connector 200 is configured to be mounted to the second electrical component 201 so as to place the second electrical contacts 204 in electrical communication with the second electrical component 201. The third electrical connector 300 is configured to he mounted to the third electrical component 301 so as to place the third electrical contacts 304 in electrical communication with the third electrical component 301. The third electrical contacts 304 can all be identical to each other. For instance, the third electrical contacts 304 can have the same size and shape as each other.

The first electrical component 101 can be of a first type, and the second electrical component 201 can be of a second type that is different than the first type. For instance, the first electrical component 101 can be configured as a substrate, such as a printed circuit board, and the second electrical component 201 can be configured as at least one cable, such as a plurality of electrical cables. Thus, in accordance with one embodiment, the first electrical connector 100 can be referred to as a board connector, and the second electrical connector 200 can be referred to as a cable connector. The substrate includes a plurality of electrical traces are placed in electrical communication with the electrical contacts 104 whet t first electrical connector 100 is mounted to the first electrical component 101. The electrical cables can include electrical conductors that are placed in electrical communication with the electrical contacts 204 when the second electrical connector 200 is mounted to the second electrical component 201. The third electrical component 301 can be configured as a substrate, such as a printed circuit board, having electrical traces that are placed in electrical communication with the electrical contacts 304 when the third electrical connector 300 is mounted to the third electrical component 301. Thus, the third electrical component 301 can be of the first type that is the same type of the first electrical component 101. In accordance with one embodiment, the third electrical component 301 can be configured as a backplane, or can alternatively be configured as a midplane, daughter card, or any suitable alternative electrical component. The first electrical component 101 can be configured as a daughter card, or can alternatively be configured as a backplane, a midplane, or any suitable alternative electrical component.

The first, second, and third electrical connectors 100, 200, and 300 can be manufactured by stamped leadframes, stamped crosstalk shields, and simple resin overmolding. No expensive plastics with conductive coatings are required. A flexible beam to flexible beam mating interface has been shown in simulation to reduce stub length, which in turn significantly shifts or lessens the severity of unwanted insertion loss resonances. Unless otherwise indicated herein, the first, second, and third electrical connectors can, for instance, be configured as described in U.S. Patent Application Publication No. 2013/0273781, published Oct. 17, 2013, the disclosure of which is hereby incorporated by reference as if set forth in its entirety herein.

Various structures of the electrical connector assembly 10, including each of the first electrical connector 100, the second electrical connector 200, and the third electrical connector 300, are described herein as extending horizontally along a first or longitudinal direction "L" and a second or lateral direction "A" that is substantially perpendicular to the longitudinal direction 1, and vertically along a third or transverse direction "T" that is substantially perpendicular to each of the longitudinal direction Land the lateral directions A. Thus, unless otherwise specified herein, the terms "lateral," "longitudinal," and "transverse" are used to describe the orthogonal directional components of various components. Further, the term "in" when used with a specified direction component is intended to refer to the single specified direction, and the term "along" when used with a specified direction component is intended to refer to either or both of opposed directions. It should be appreciated that while the longitudinal and lateral directions are illustrated as extending along a horizontal plane, and that while the transverse direction is illustrated as extending along a vertical plane, the planes that encompass the various directions may differ during use, depending, for instance, on the orientation of the various components. Accordingly, the directional terms "vertical" and "horizontal" are used to describe the electrical connector assembly 10 and its components as illustrated merely for the purposes of clarity and convenience, it being appreciated that these orientations may change during use.

Figure 1C:
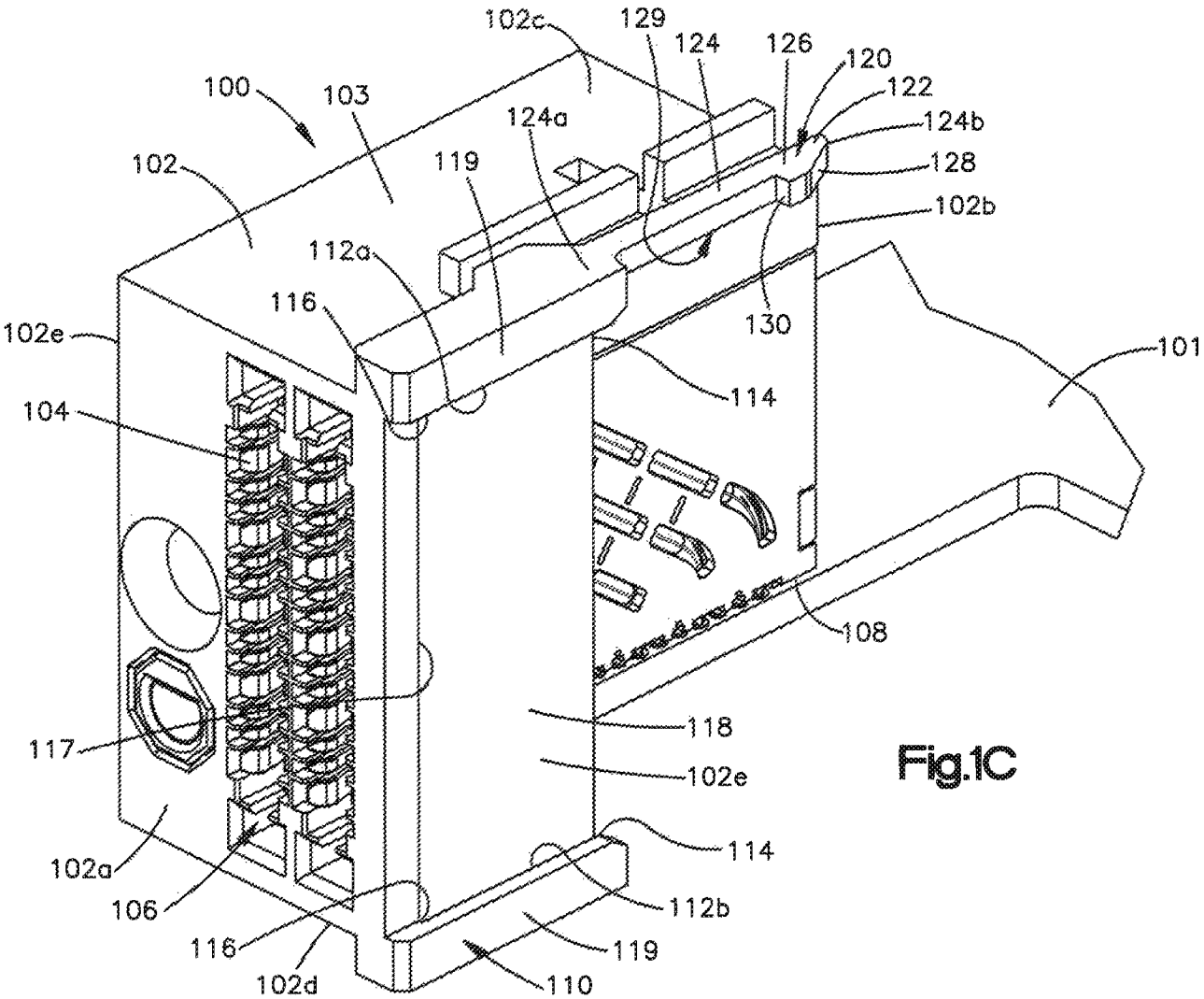
FIG. 1C is a perspective view of the first electrical connector of the electrical connector assembly illustrated in FIG. 1A, shown mounted to a substrate.
Figure 1D:
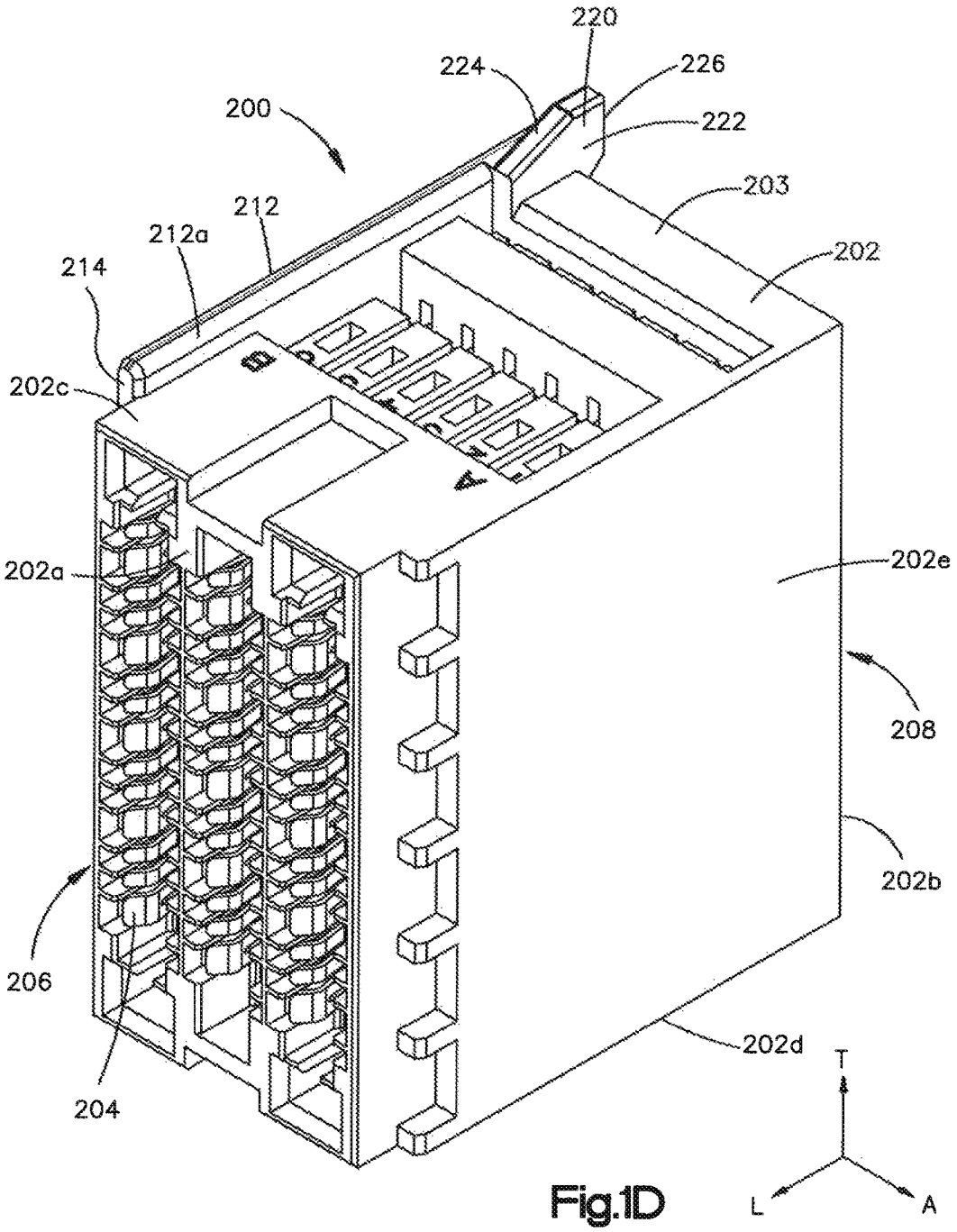
FIG. 1D is a perspective view of the second electrical connector illustrated in FIG. 1A.
Figure 2A:
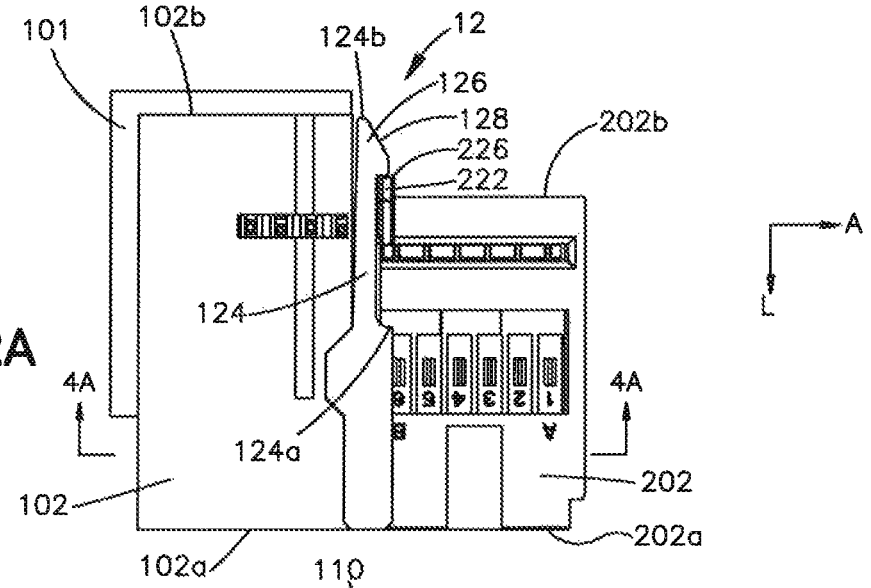
FIG. 2A is atop plan view of an electrical connector subassembly of the electrical connector assembly shown in FIG. 1A, shown with the first electrical connector mounted to the substrate, wherein the subassembly includes the first and second electrical connectors that include first and second connector housings, respectively, and respective electrical contacts supported by the connector housings.
Figure 2B:
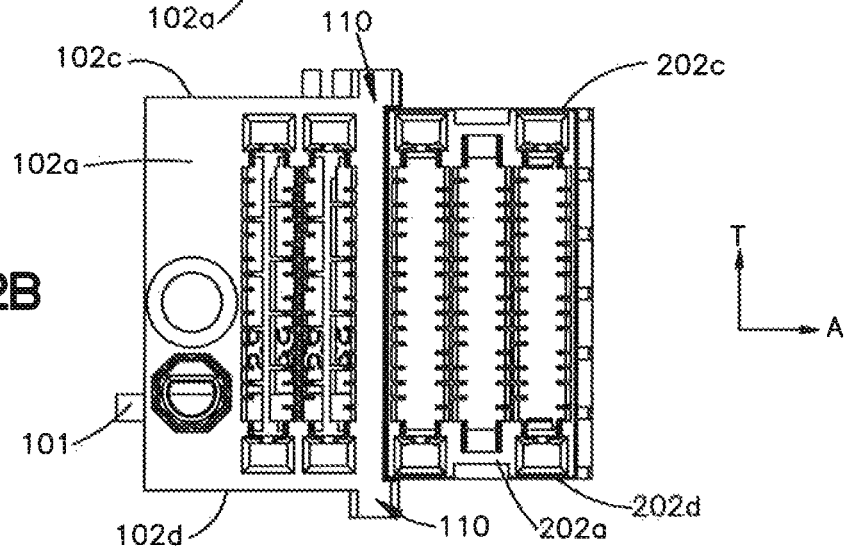
FIG. 2B is a front plan view of the electrical connector subassembly illustrated in FIG. 2A, with the electrical contacts removed.
Figure 2C:
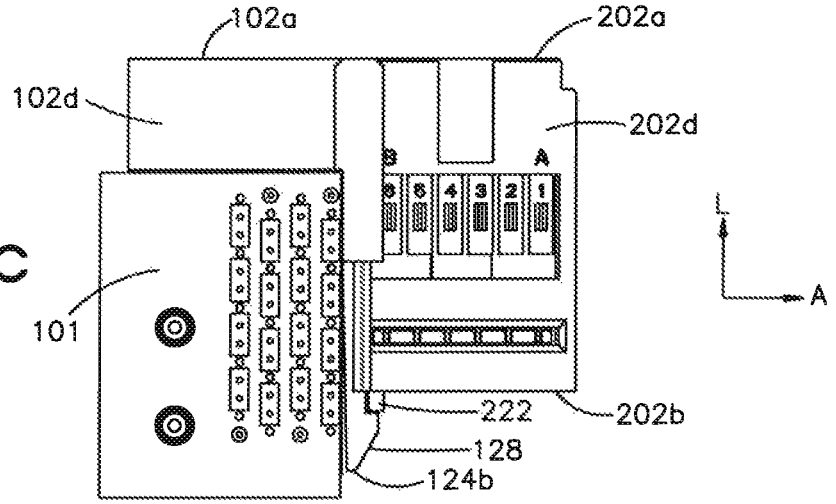
FIG. 2C is a bottom plan view of the electrical connector subassembly, shown with the first electrical connector mounted to the substrate.

Referring also to FIGS. 1C and 1D, in accordance with the illustrated embodiment, the first and second electrical connectors 100 and 200 are configured to be attached to each other to define an electrical connector subassembly 12. The electrical connector subassembly 12 is configured to be mated to at least one complementary electrical connector along a mating direction so as to place the first and second electrical connectors 100 and 200 in electrical communication with the at least one complementary electrical connector, which can include a plurality of electrical connectors, In accordance with the illustrated embodiment, the at least one complementary electrical connector is the third electrical connector 300 having the plurality of electrical contacts 304 that can be supported by the connector housing 302, which can be a single monolithic housing. Thus, the electrical connector subassembly can be configured to be mated to the third electrical connector 300 along the mating direction no as to place each of the first and second electrical connectors 100 and 200, and in particular the respective electrical contacts 104 and 204, in electrical communication with the third electrical connector 300, and in particular the respective electrical contacts 304. The mating direction can, for instance, define the longitudinal direction L. Accordingly, the electrical connector subassembly 12 can be mated to the third electrical connector 300 so as to place each of the first electrical component 101 and the second electrical component 201 in electrical communication with the third electrical component 301. Alternatively, the electrical connector subassembly 12 can be mated to a plurality of electrical connectors that can be mounted to the third electrical component 301, so as to place each of the first electrical component 101 and the second electrical component 201 in electrical communication with the third electrical component 301.

The first electrical connector 100 defines a first mating interface 106 and a first mounting interface 108. Similarly, the second electrical connector 200 defines a second mating interface 206 and a second mounting interface 208. Similarly, the at least one complementary electrical connector, for instance the third electrical connector 300, can define a third mating interface 306 and a third mounting interface 308. The first and second mating interfaces 106 and 206 can be each configured to engage the third mating interface 306 when the electrical connector subassembly 12 is mated with the third electrical connector 300. Thus, it should be appreciated that the mating interface 306 of the third electrical connector 300 can be sized so as to mate with each of the first and second mating interfaces 106 and 206. The first mounting interface 108 is configured to engage the first electrical component 101 when the first electrical connector 100 is mounted to the first electrical component 101. The second mounting interface 208 is configured to engage the second electrical component 201 when the second electrical connector 200 is mounted to the second electrical component 201. The third mounting interface 308 is configured to engage the third electrical component 301 when the third electrical connector 300 is mounted to the third electrical component 301.

The first connector housing 102 can define a housing body 103 that defines the respective mating interface 106, the respective mounting interface 108, and can support the respective electrical contacts 108. Similarly, the second connector housing 202 can define a housing body 203 that defines the respective mating interface 206, the respective mounting interface 208, and can support the respective electrical contacts 204. Similarly, the third connector housing 302 can define a housing body 303 that defines the respective mating interface 306, the respective mounting interface 308, and can support the respective electrical contacts 304.

The first electrical contacts 104 include respective mating ends and mounting ends. In particular, the first electrical contacts 104 can include signal contacts having mating ends and mounting ends, and ground contacts having ground mating ends and ground mounting ends. The ground contacts can be defined by individual ground contacts that each define a around mating end and a ground mounting end, or can be defined by a ground plate that defines a plurality of ground mating ends and ground mounting ends. The mating ends of the first electrical contacts 104 can extend along the mating interface 106. The mating ends of the first electrical contacts 104 can further be arranged along a column direction, which can be defined by the transverse direction T that is substantially perpendicular to the longitudinal direction L. For example, the mating ends of the first electrical contacts 104 can include differential signal pairs along the column direction and ground contacts spaced between adjacent ones of the differential signal pairs along the column direction.

The second electrical contacts 204 can likewise include respective mating ends and mounting ends. In particular, the first electrical contacts 204 include signal contacts having mating ends and mounting ends, and around contacts having at least ground mating ends. For instance, the ground contacts can be defined by a ground plate that defines a plurality of ground mating ends and ground mounting ends. Alternatively, the second electrical contacts 204 can include individual ground contacts that each defines a around mating end and a ground mounting end. The mating ends of the second electrical contacts 204 can extend along the mating interface 206. The mating ends of the second electrical contacts 204 can further be arranged along the column direction, which can be defined by the transverse direction T that is substantially perpendicular to the longitudinal direction L. For example, the mating ends of the second electrical contacts 204 can include differential signal pairs along the column direction and ground contacts spaced between adjacent ones of the differential signal pairs along the column direction. The mounting ends of the electrical contacts 104 can be configured differently than the mounting ends of the electrical contacts 204. For instance, the mounting ends of the electrical contacts 104 can be configured to attach to an underlying printed circuit board, while the mounting ends of the electrical contacts 204 can be configured to attach to respective conductors of electrical cables.

The third electrical contacts 304 include respective mating ends and mounting ends. In particular, the first electrical contacts 304 include signal contacts having mating ends and mounting ends, and ground contacts having ground mating ends and ground mounting ends. The ground contacts can be defined by individual ground contacts that each defines a ground mating end and a ground mounting end, or can be defined by a ground plate that defines a plurality of ground mating ends and ground mounting ends. The mating ends of the third electrical contacts 304 can extend along the mating interface 306. The mating ends of the second electrical contacts 304 can further be arranged along the column direction, which can be defined by a transverse direction T that is substantially perpendicular to the longitudinal direction L. For example, the mating ends of the third electrical contacts 304 can include differential signal pairs along the column direction and ground contacts spaced between adjacent ones of the differential signal pairs along the column direction.

In accordance with the illustrated embodiment, when the first electrical connector 100 is mated to the third electrical connector 300, the mating ends of the first electrical contacts 104 mate with the mating ends of a first plurality of the third electrical contacts 304. For instance the signal contacts of the first electrical contacts 104 mate with a first plurality of signal contacts of the third electrical contacts 304, and the ground mating ends of the first electrical contacts 104 mate with a first plurality of the ground mating ends of the third electrical contacts 304.

Similarly, when the second electrical connector 200 is mated to the third electrical connector 300, the mating ends of the second electrical contacts 204 can mate with the mating ends of a second plurality of the third electrical contacts 304. For instance the signal contacts of the second electrical contacts 204 mate with a second plurality of signal contacts of the third electrical contacts 304, and the ground mating ends of the second electrical contacts 204 mate with a second plurality of the ground mating ends of the third electrical contacts 304.

The first plurality of signal contacts of the third electrical contacts 304 can be spaced from the second plurality of signal contacts of the third electrical contacts 304 along the lateral direction A that is perpendicular to both the longitudinal direction L and the transverse direction T. Similarly, the first plurality of ground mating ends of the third electrical contacts 304 can be spaced from the second plurality of signal contacts of the third electrical contacts 304 along the lateral direction A. For example, the housing 302, and thus the third electrical connector 300, can include a first region and a second region that is spaced from the first region along the lateral direction A. The first region can include a first region of the mating interface 306 and a first region of the mounting interface 308. The second region can include a second region of the mating interface 306 and a second region of the mounting interface 308. In one embodiment, when the electrical connector subassembly 12 is mated to the third electrical connector 300, the first region of the mating interface 306 is engages the mating interface 106 of the first electrical connector 100, and the second region of the mating interface 306 is engages the mating interface 206 of the second electrical connector 200. The first plurality of ground mounting ends of the third electrical contacts 304 can mount onto a first region of the third electrical component 301, and the second plurality of ground mounting ends of the third electrical contacts 304 can mount onto a second region of the third electrical component 301 that is spaced from the first region of the third electrical component 301 along the lateral direction A. Alternatively, the first and second regions of the third electrical component 301, and the first and second pluralities of ground mounting ends of the third electrical contacts 104 can be positioned anywhere as desired depending, for instance, of the routing of the electrical contacts 304 in the connector housing 302.

The mounting ends of the first electrical contacts 104 are configured to be placed in electrical communication with the first electrical component 101. The mounting ends of the second electrical contacts 204 are configured to be placed in electrical communication with the second electrical component. For instance, the mounting ends of the electrical signal contacts are configured to be placed in electrical communication with electrical signal conductors of the electrical cables, and the ground plate is configured to be placed in electrical communication with aground jacket of each of the electrical cables, a drain wire of the electrical cables, or the like. The electrical connector subassembly 12 can include the first and second electrical components 101 and 201. Thus, when the first electrical connector 100 is mounted to the first electrical component 101, and the second electrical connector 200 is mounted to the second electrical component 201, the electrical connector subassembly 12 can be mated to the third electrical connector 300 so as to place the first electrical component in electrical communication with the first region of the third electrical component 301, and to place the second electrical component 201 in electrical communication with the second region of the third electrical component 301.

As described above, the first and second electrical connectors 100 and 200 of the electrical connector subassembly 12 are configured to be attached to each other or be otherwise supported by each other prior to mating the electrical connector subassembly 12 to at least one complementary electrical connector, for instance the third electrical connector 300. Furthermore, the first and second electrical connectors can be mounted to the respective first and second electrical components 101 and 201 prior to mating the electrical connector subassembly 12 to at least one complementary electrical connector, for instance the third electrical connector 300.

Referring also to FIGS. 2A to 4, in accordance with one embodiment, the first and second electrical connectors 100 and 200 can be attached to each other or otherwise supported by each other such that the first and second mating interfaces 106 and 206, respectively, are spaced from each other along the lateral direction A so as to be in alignment with the first and second regions of the mating interface 306 of the third electrical connector 300 along the longitudinal direction L prior to mating the electrical connector subassembly 12 with the third electrical connector 300. Further, the first and second mating interfaces 106 and 206 can be aligned with each other along the lateral direction A, or otherwise disposed adjacent to each other along at least the lateral direction A. Thus, the first and second mating interfaces 106 and 206 can be positioned side-by-side along the lateral direction A. The first and second connector housings 102 and 202 can include respective first and second complementary engagement members 110 and 210, respectively, that are configured to engage each other so as to attach the first and second connector housings 102 and 202 to each other without mating the electrical contacts 104 with each other. Thus, the first and second complementary engagement members 110 and 210, respectively, can be configured to engage each other so as to attach the first and second connector housings 102 and 202 to each other without placing the mating ends of the electrical contacts 104 and 204 in contact with each other.

Figure 3B:
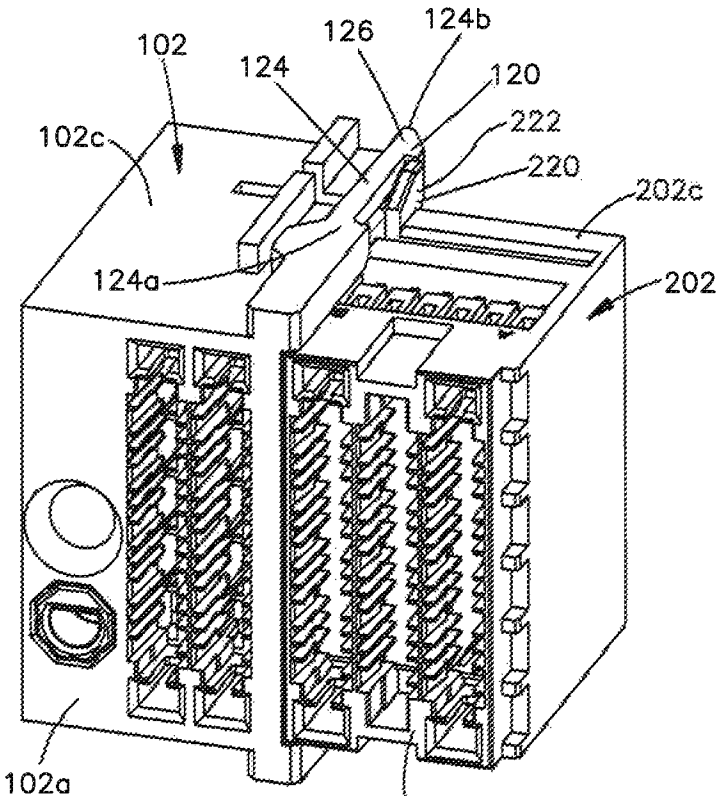
FIG. 3B is a perspective view of the first connector housing and the second connector housing attached to each other in a fully engaged position.
Figure 3A:
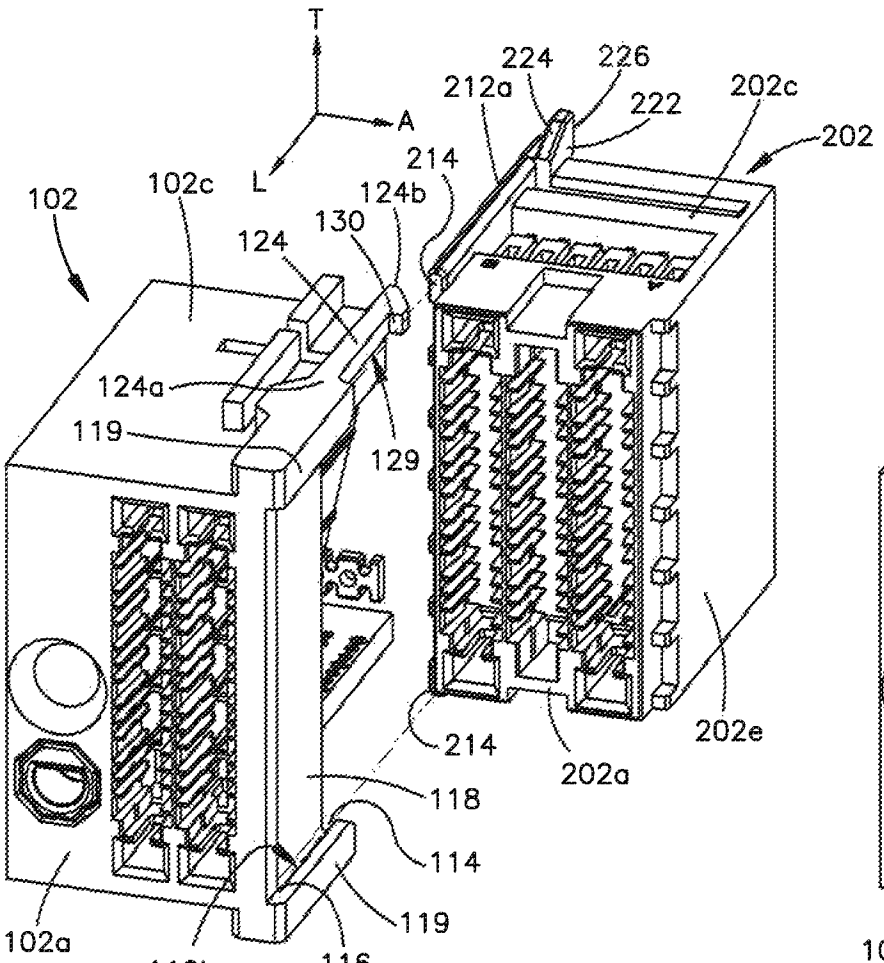
FIG. 3A is a perspective view of the first connector housing of the first electrical connector aligned to be attached to the second connector housing of the second electrical connector along an insertion direction.
Figure 3D:
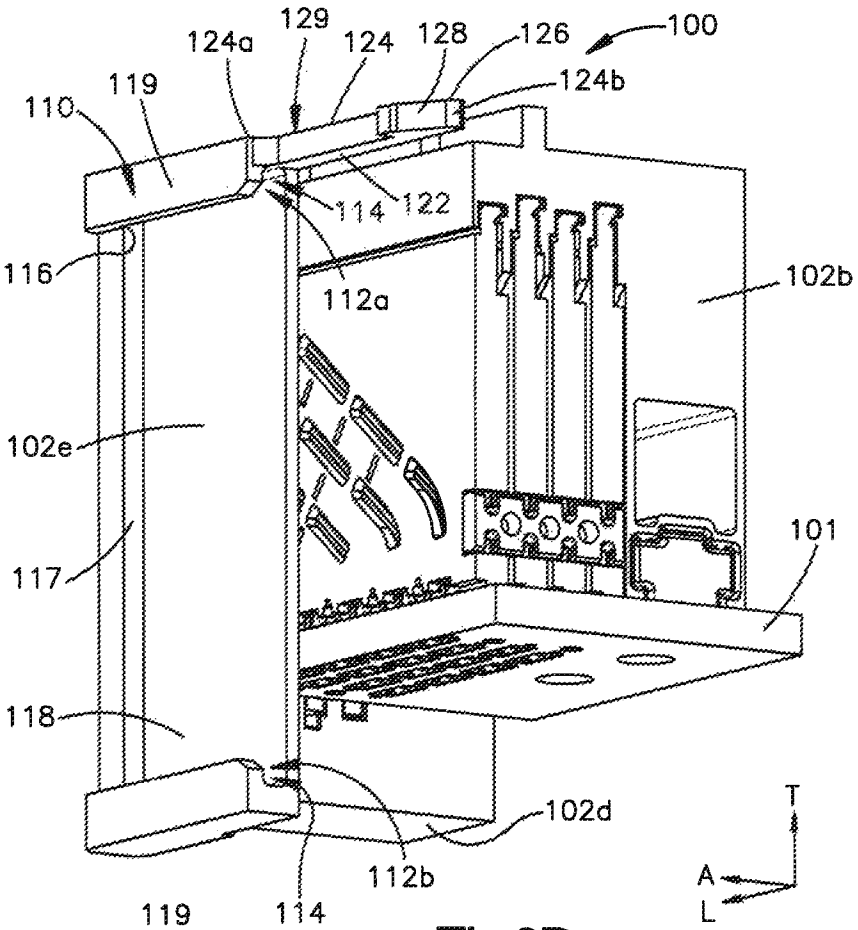
FIG. 3D is a perspective view of the first electrical connector, shown mounted to the substrate.

Referring in particular to FIGS. 1C, 3A, and 3D, in accordance with the illustrated embodiment, the first engagement member 110 can be configured as at least one guidance slot 112 that is defined by the connector housing 102. For instance, the first engagement member can include a first guidance slot 112*a* and a second guidance slot 112*b* that is spaced from the first guidance slot 112*a* along any direction as desired. For instance, the second guidance slot 112*b* can be spaced from the first guidance slot 112*a* along the transverse direction T. The first guidance slot 112*a* can be spaced a first distance from the mounting interface 108 along the transverse direction T, and the second guidance slot 112*b* can be spaced a second distance from the mounting interface along the transverse direction T that is less than the first distance. Thus, the first guidance slot 112*a* can be referred to as an upper guidance slot, and the second guidance slot 112*b* can be referred to as a lower guidance slot that is disposed below the upper guidance slot. The at least one guidance slot 112, including the first and second guidance slots 112*a* and 112*b*, can be elongate along any direction of elongation as desired so as to define first and second ends 114 and 116 spaced along the direction of elongation. It should be appreciated, of course, that the first and second ends 114 and 116 can be spaced along any direction as desired.

At least one of the first and second ends 114 and 116 and can be open at least at one end, which can define an insertion end. For instance, in accordance with the illustrated embodiment, the first end 114 is open at least at one end so as to define an insertion end 114. Accordingly, the second electrical connector 200 is attachable to the first electrical connector along an insertion direction from the first end 114 toward the second end 116. In accordance with one embodiment, the direction of insertion and elongation is the longitudinal direction, such that the first and second ends 114 and 116 are spaced from each other along the longitudinal direction L. The first end 114 can be spaced a first distance from the mating interface 106 along the longitudinal direction L, and the second end 116 can be spaced a second distance from the mating interface 106 along the longitudinal direction L that is less than the first distance. Thus, the first end 114 can be disposed rearward with respect to the second end 116 along the longitudinal direction L, whereby the mating interface 106 defines the front end of the connector housing 102.

The connector housing 102 can define a first surface 118 and a second surface 119 that is spaced outward from the first surface 118 along the lateral direction A so as to define the at least one guidance slot 112. The connector housing 102 can further define a front end 102*a* and an opposed rear end 102*b* that is spaced from the front end 102*a* along the longitudinal direction L, a top end 102*c* and an opposed bottom end 102*d* that is spaced from the top end 102*c* along the transverse direction T, and opposed first and second sides 102*e* that are spaced from each other along the lateral direction A. As shown, the front end 102*a* can define the mating interface 106 and the bottom end 102*d* can define the mounting interface 108, though it will be understood that the mating interface 106 and the mounting interface 108 can be alternatively oriented with respect to each other as desired. The first surface 118 can define one of the first and second sides 102*e* of the connector housing 102 that are spaced along the lateral direction A, and the second surface 119 can be spaced from the first side surface 118 along the lateral direction A away from the other of the first and second sides 102*e*. For instance, the connector housing 102 can define first and second pairs of first and second surfaces 118 and 119, each pair defining a respective one of the first and second guidance slots 112*a* and 112*b*. The connector housing 102 can further define a stop surface 117 disposed proximate to the second end 116 that is positioned to so as to abut the second connector housing 202 when the first and second engagement members 110 and 210 are fully engaged, thereby preventing further movement of the second electrical connector 200 relative to the first electrical connector 100 along the insertion direction.

Figure 3C:
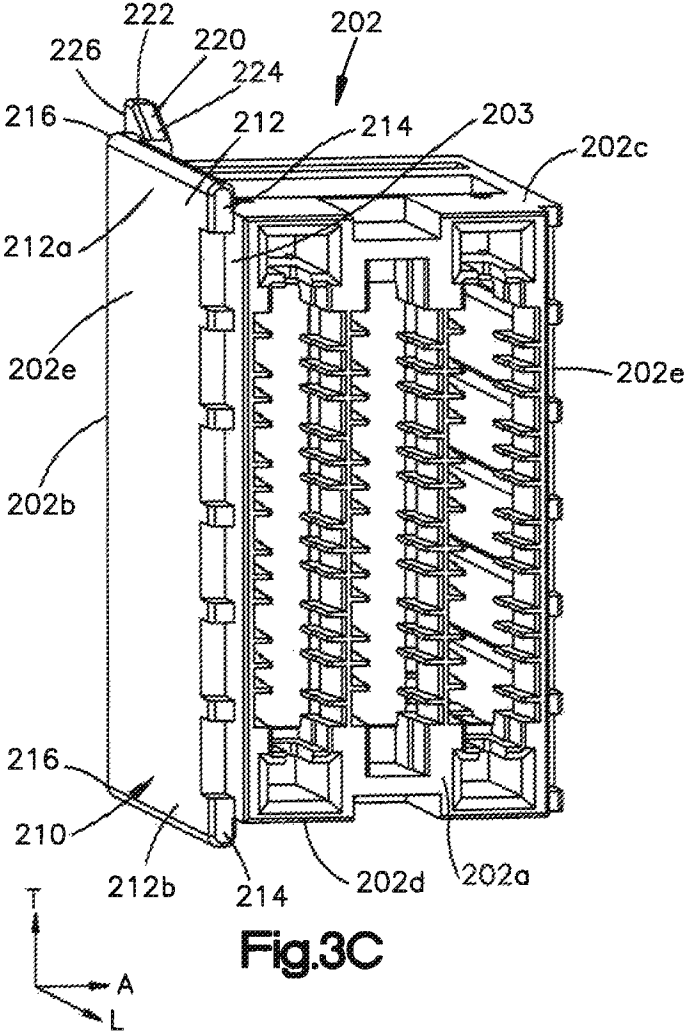
FIG. 3C is a perspective view of the second connector housing of the second electrical connector.
Figure 4:
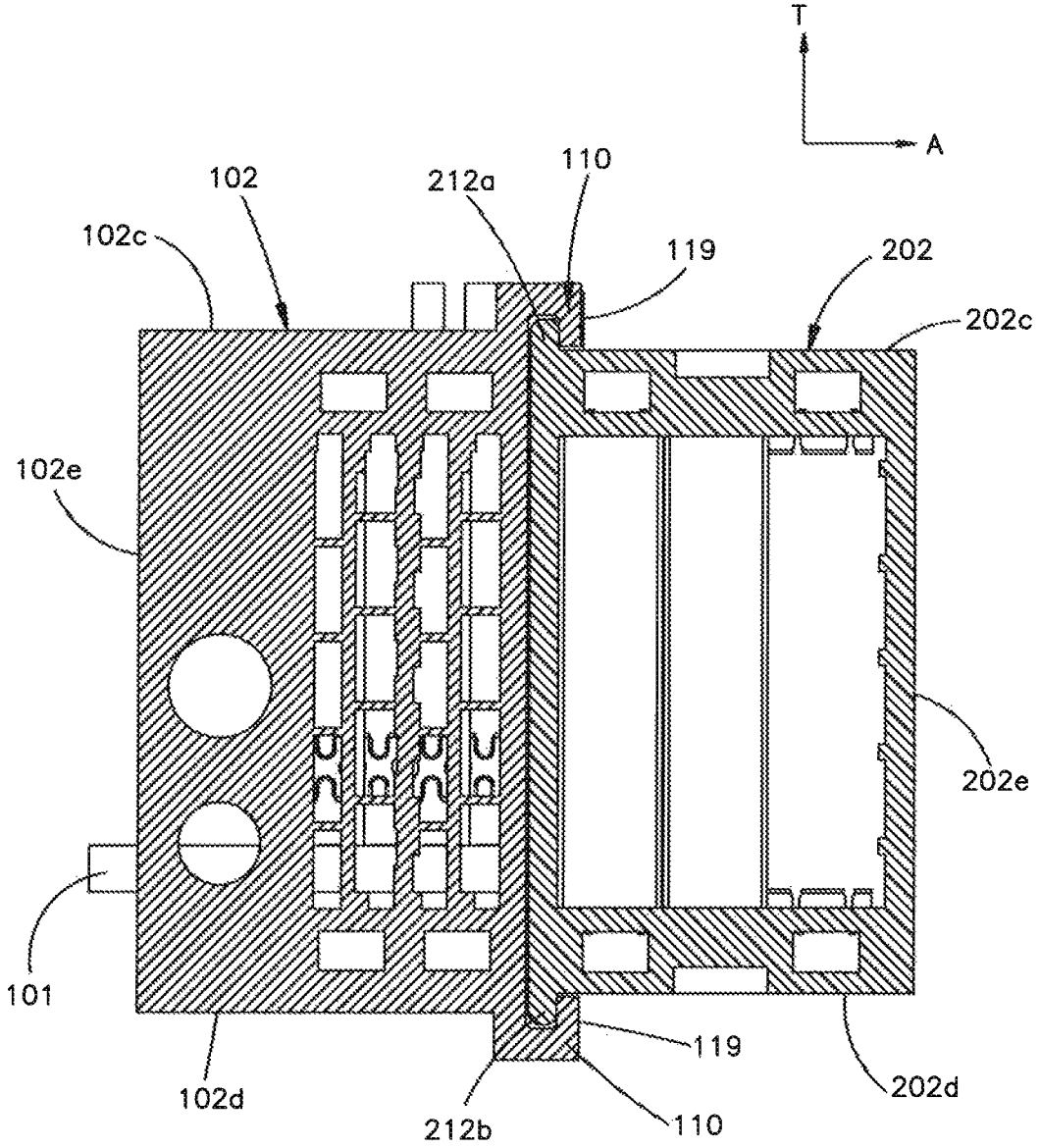
FIG. 4 is a sectional front view of the electrical connector subassembly shown in FIG. 2A, but without showing the electrical contacts of the first and second electrical connectors, wherein the first and second connector housings are in the fully engaged position.

Referring in particular to FIGS. 1D, 3A, and 3C, in accordance with one embodiment, the second engagement member 210 can be configured as at least one guidance rail 212 that is defined by the connector housing 202. The connector housing 202 can further define a front end 202*a* and an opposed rear end 202*b* that is spaced from the front end 202*a* along the longitudinal direction L, atop end 202*c* and an opposed bottom end 202*d* that is spaced from the top end 202*c* along the transverse direction T, and opposed first and second side walls 202*e* that are spaced from each other along the lateral direction A. As shown, the front end 202*a* can define the mating interface 206 and the bottom end 202*d* can define the mounting interface 208, though it will be understood that the mating interface 206 and the mounting interface 208 can be alternatively oriented with respect to each other as desired. The second engagement member 210 can include a first guidance rail 212*a* and a second guidance rail 212*b* that is spaced from the first guidance rail 212*a* along any direction as desired. The second guidance rail 212*b* can be spaced from the first guidance rail 212*a* along the transverse direction T. The first and second guidance rails 212*a* and 212*b* can be defined by uppermost and lowermost ends, respectively, of one of the first and second side walls 202*e* of the connector housing 202 that are spaced from each other along the lateral direction A. For instance, the first guidance rail 212*a* can be spaced a first distance from the mounting interface 208 along the transverse direction T, and the second guidance rail 212*b* can be spaced a second distance from the mounting interface 208 along the transverse direction T that is less than the first distance. Thus, the first guidance rail 212*a* can be referred to as an upper guidance rail, and the second guidance rail 212*b* can be referred to as a lower guidance rail that is disposed below the upper guidance rail. The at least one guidance rail 212, including the first and second guidance rails 212*a* and 212*b*, can be elongate along any direction of elongation as desired so as to define first and second ends 214 and 216 spaced from each other along the direction of elongation. It should be appreciated, of course, that the first and second ends 214 and 216 can be spaced along any direction as desired.

Referring in particular to FIGS. 1A-B, 2A-D, 3B, and 4, the second electrical connector 200 is attachable to the first electrical connector 100 along the insertion direction from the first end 114 toward the second end 116. In accordance with one embodiment, the first end 214 of each of the guidance rails 212*a* and 212*b* are inserted into the first ends 114 of the guidance slots 112, such that the guidance rails 212*a* and 212*b* are disposed between the first and second surfaces 118 and 119. Because the distance between the guidance rails 212*a* and 212*b* is greater than the distance between the two second surfaces 19 along the transverse direction T, and less than a distance defined by the first and second guidance slots 112*a* and 112*b* along the transverse direction T, the first and second guidance rails 212*a* and 212*b* are captured in the first and second guidance slots 112*a* and 112*b*, respectively, The second electrical connector 200 is then moved forward, in the mating direction, while the guidance rails 212*a* and 212*b* are in the respective guidance slots 112*a* and 112*b*, to a fully engaged position whereby the housing 202, and in particular a portion of the front end 202*a* of the housing 202, contacts the stop surface 117. When the guidance rails 212*a* and 212*b* are in the fully engaged position in the guidance slots 112*a* and 112*b*, the first and second electrical connectors 100 and 200 are supported by each other. Thus, the first and second electrical connectors 100 and 200 can be configured to mate simultaneously with the third electrical connector 300 as the electrical connector subassembly 12 is mated to the third electrical connector 300.

It should be appreciated that while the first engagement member 110 is configured as the at least one guidance slot 112 and the second engagement member is configured as the at least one guidance rail 212, the first and second engagement members can be configured in accordance with any suitable embodiment as desired. For instance, the first engagement member 110 can be configured as the at least one guidance rail 212, and the second engagement member 210 can be configured as the at least one guidance slot 112 configured to receive the at least one guidance rail so as to attach the first and second electrical connectors 100 and 200 to each other.

Furthermore, each of the first and second connector housings 102 and 202 can include complementary securement members 120 and 220, respectively, that are configured to engage each other so as to secure the first and second connector housings 102 and 202 to each other after the complementary engagement members 110 and 210 have attached to each other. In particular, the securement members 120 and 220 are configured to engage so as to prevent movement of one of the first and second electrical connectors 100 and 200 relative to the other of the first and second electrical connectors 100 and 200 in a direction opposite the insertion direction that would cause the engagement members 110 and 210 to disengage from each other.

In accordance with one embodiment, the first securement member 120 can be configured as at least one latch member 122 that is defined by the connector housing 102, The latch member 122 can include a latch arm 124 that extends in the direction from the engagement member 110 opposite the insertion direction. The latch arm 124 can define a proximal end 124*a* and a distal end 124*b*. The distal end 124*b* can be rearwardly spaced from the proximal end 124*a* along the longitudinal direction L. The latch member 122 can further include a latch body 126 that extends from the distal end 124*b*, which can define a free end of the latch arm 124. The latch body 126 can define a cam surface 128 that extends outward from the housing body 103 along the lateral direction A as it extends forward along the longitudinal direction L and can define a retention surface 130 that extends inward along the lateral direction with respect to the cam surface 128, for instance from the cam surface 128, toward, for instance to, the latch arm 124. The latch arm 124 can define a retention notch 129 disposed between the retention surface 130 and the proximal end 124*a* of the latch arm 124.

The second securement member 220 can be configured as at least one catch member 222 that is defined by the connector housing 202. The catch member 222 can include a cam surface 224 that is angled in toward the housing body, for instance along the transverse direction T, as it extends forward along the longitudinal direction L. The catch member 222 can define a retention surface 226 that can be defined at any location of the catch member 222 as desired. For instance, the retention surface 226 can be disposed at a rear end of the catch member 222.

During operation, the second electrical connector 200 moves along the insertion direction relative to the first electrical connector 100 when the engagement members 110 and 210 are engaged. As the first and second engagement members 110 and 210 approach the fully engaged position, the catch member 222 rides along the latch body 126, which can cause at least one or both of the catch member 222 and the latch body 126 to resiliently deflect from a respective first position away from the other of the catch member 222 and the latch body 126. The deflection allows the catch member 222 to move past the latch body 126 along the insertion direction. When the retention surface 226 of the catch member 222 passes the retention surface 130 along the insertion direction, for instance when the retention surface 226 is forward of the retention surface 130, the deflected at least one of the catch member 222 and the latch body 126 returns to the respective first position, such that the retention surfaces 130 and 226 are aligned along the insertion direction. Thus, the securement members 120 and 220 define a secured configuration. For instance, at least a portion up to all of the catch member 222 can be disposed in the retention notch 129.

When the securement members 120 and 220 are in the secured configuration, interference between the retention surfaces 130 and 226 prevents movement of the second connector 200 with respect to the first electrical connector 100 in a removal direction that is opposite the insertion direction. At least one or both of the latch member 122 and the catch member 222 can be deflectable away from the other of the latch member 122 and the catch member 222 so as to remove the retention surfaces 130 and 226 from interference with each other in the insertion direction. When the at least one or both of the latch member 122 and the catch member 222 are deflected, the second electrical connector 200 can be removed from the first electrical connector 100 by moving the second electrical connector 200 with respect to the first electrical connector 100 in the removal direction until the engagement members 110 and 210 have disengaged from each other. It should be appreciated that while the first electrical connector 100 is configured to be mounted to a printed circuit board, and the second electrical connector 200 is configured to be mounted to a plurality of electrical cables, the electrical connector subassembly 12 can alternatively be constructed such that the first electrical connector 100 is configured to be mounted to a plurality of cables, and the second electrical connector 200 is configured to be mounted to a printed circuit board. Thus, it should be appreciated that the securement members 120 and 220 can engage each other so as to releasably secure the first and second electrical connectors 100 and 200 when the first and second engagement members 110 and 210 are in the fully engaged position. When the first and second engagement members 110 and 210 are in the fully engaged position, the mating interfaces 106 and 206 can be coplanar with each other to as to substantially simultaneously mate with the third electrical connector 300.

The connector housing 302 can receive the connector housings 102 and 202 when the electrical connector subassembly 12 is mated with the third electrical connector 300. Alternatively, the connector housings 102 and 202 can receive the connector housing 302 when the electrical connector subassembly 12 is mated with the third electrical connector 300. Alternatively still, one of the connector housings 102 and 202 can receive the connector housing 302 and the connector housing 302 can receive the other of the connector housings 102 and 202 when the electrical connector subassembly is mated with the third electrical connector 300. Alternatively still, the connector housings 102 and 202 can abut the connector housing 302, for instance at the respecting mating interfaces, when the electrical connector subassembly 12 is mated with the third electrical connector 300. The connector housings 102, 202, and 302 can include guidance members of the type described in U.S. Patent Application Publication No. 2013/0273781, published Oct. 17, 2013, the disclosure of which is hereby incorporated by reference as if set forth in its entirety herein.

As described above, the engagement members 110 and 210, and the securement members 120 and 220, can be defined by the respective connector housings 102 and 202. For instance, they can be monolithic with the respective body 103 and 203 of the connector housing 102 and 202, respectively, or can be otherwise attached to the respective body 103 and 203 as desired, Each of the first, second, and third electrical connectors 100, 200, and 300, respectively, can be constructed as desired. For instance, the first electrical connector 100 can be constructed as a right-angle connector, whereby the mating interface 106 is oriented perpendicular with respect to the mounting interface 108. Thus, the mating ends of the electrical contacts 104 can be oriented perpendicular with respect to the mounting ends of the electrical contacts 104. Alternatively, the first electrical connector can be constructed as a vertical connector, whereby the mating interface 106 is oriented parallel with respect to the mounting interface 108. Thus, the mating ends of the electrical contacts 104 can be oriented parallel with respect to the mounting ends of the electrical contacts 104.

Similarly, the second electrical connector 200 can be constructed as a vertical connector, whereby the mating interface 206 is oriented parallel with respect to the mounting interface 208. Thus, the mating ends of the electrical contacts 204 can be oriented parallel with respect to the mounting ends of the electrical contacts 204. Alternatively, the second electrical connector 200 can be constructed as a right-angle connector, whereby the mating interface 206 is oriented perpendicular with respect to the mounting interface 208. Thus, the mating ends of the electrical contacts 204 can be oriented perpendicular with respect to the mounting ends of the electrical contacts 204. In accordance with the illustrated embodiment, when the first and second electrical connectors 100 and 200 are attached to each other, the electrical cables can be spaced above the printed circuit board to which the first electrical connector 100 is mounted, or can be otherwise routed as desired.

The third electrical connector 300 can be constructed as a vertical connector, whereby the mating interface 306 is oriented parallel with respect to the mounting interface 308. Thus, the mating ends of the electrical contacts 304 can be oriented parallel with respect to the mounting ends of the electrical contacts 304. Alternatively, the third electrical connector 300 can be constructed as a right-angle connector, whereby the mating interface 306 is oriented perpendicular with respect to the mounting interface 308. Thus, the mating ends of the electrical contacts 304 can be oriented perpendicular with respect to the mounting ends of the electrical contacts 304. It should be appreciated that, while the electrical connector subassembly 12 can be mated directly to the third electrical connector so as to place the electrical connector subassembly 12 in electrical communication with the third electrical connector 300, the electrical connector subassembly 12 can alternatively be mated to a midplane assembly that is, in turn, mated to the third electrical connector 300 so as to place the electrical connector subassembly 12 in electrical communication with the third electrical connector 300. The midplane can be constructed as described in U.S. Patent Application Publication No. 2013/0273781, published Oct. 17, 2013, the disclosure of which is hereby incorporated by reference as if set forth in its entirety herein.

A method can include any steps as described above. For instance, the method can include the steps of 1) supporting first and second electrical connectors by each other without causing the first and second electrical connectors to mate with each other, each of the first and second electrical connectors including a respective connector housing and a respective plurality of electrical contacts supported by the respective connector housing, 2) mounting the first electrical connector to a first electrical component of a first type, 3) mounting the second electrical connector to a second electrical component of a second type that is different than the first type, and 3) after the supporting step, simultaneously mating the first and second electrical connectors with a third electrical connector.

The mating step can include the step of bringing the electrical contacts in to physical and electrical contact with complementary ones of electrical contacts of the third electrical connector. The method step can occur after the mounting steps. Each of the first and second electrical connectors can define respective mating interfaces that are configured to engage the third electrical connector during the mating step, and the supporting step can include the step of placing the mating interfaces of the first and second electrical connectors side-by-side with each other. The supporting step can include the step of placing the mating interfaces of the first and second electrical connectors in a coplanar relationship. The mating step can occur along a mating direction, and the supporting step can include the step of moving one of the first and second electrical connectors with respect to the other of the first and second electrical connectors in the mating direction. The supporting step can include the step of inserting at least one guidance rail of one of the first and second electrical connectors into at least one guidance slot of the other of the first and second electrical connectors along an insertion direction.

The method can further include the step of securing the first and second electrical connectors to each other so as to prevent removal of the first and second electrical connectors from the other of the first and second electrical connectors. The securing step can include the step of placing respective securement members of the first and second electrical connectors in interference with each other after completion of the supporting step. The method can include the step of removing the securement members from interference with each other, and removing the first and second electrical connectors from each other. The first mounting step can include the step of mounting the first electrical connector to a printed circuit board. The second mounting step can include the step of mounting the second electrical connector to a plurality of electrical cables.

It should be appreciated that a method can include the step or steps of teaching any one or more up to all of the steps described herein, and selling the first and second electrical connectors to a third party, either before or after the supporting and securing steps have been completed.

The foregoing description is provided for the purpose of explanation and is not to be construed as limiting the electrical connector. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the electrical connector assembly is not intended to be limited to the particulars disclosed herein. For instance, it should be appreciated that structure and methods described in association with one embodiment are equally applicable to all other embodiments described herein unless otherwise indicated. Those skilled in the relevant art, having the benefit of the teachings of this specification, may effect numerous modifications to the electrical connector as described herein, and changes may be made without departing from the spirit and scope of the electrical connector, for instance as set forth by the appended claims.

What is claimed:

1. An electrical connector assembly comprising:

a first electrical connector including an electrically insulative first connector housing and a first plurality of electrical contacts supported by the first connector housing, the first plurality of electrical contacts defining respective mating ends and respective mounting ends, wherein the first electrical connector is configured to be mounted onto a first electrical component of a first type;

a second electrical connector including an electrically insulative second connector housing and a second plurality of electrical contacts supported by the second connector housing, the second plurality of electrical contacts defining respective mating ends and respective mounting ends, wherein the second electrical connector is configured to be mounted onto a second electrical component of a second type that is different than the first type; and a third electrical connector including an electrically insulative third connector housing and a third plurality of electrical contacts supported by the third connector housing, the third plurality of electrical contacts comprising respective mating ends and respective mounting ends, wherein the third electrical connector is configured to be mounted onto a third electrical component of the first type, wherein the first and second electrical connectors are configured to be supported by each other without being mated to each other and to mate with the third electrical connector.

2. The electrical connector assembly as recited in claim 1, wherein one of the first and second electrical components is a printed circuit board, and the other of the first and second electrical components comprises a plurality of electrical cables.

3. The electrical connector assembly as recited in claim 1, wherein the first, second, and third plurality of electrical contacts are the same type of electrical contacts and the mating ends of the first, second, and third plurality of electric contacts are arranged along a column direction.

4. The electrical connector assembly as recited in claim 1, wherein the first and second electrical connectors are configured to be supported by each other so as to simultaneously mate with the third electrical connector.

5. The electrical connector assembly as recited in claim 1, wherein the first electrical connector comprises a first engagement member, the second electrical connector comprises a second engagement member, and the first and second engagement members are configured to engage each other so as to attach the first and second electrical connectors to each other.

6. The electrical connector assembly as recited in claim 5, wherein the first electrical connector comprises a first securement member, the second electrical connector comprises a second securement member, and the first and second securement members are configured to engage each other so as to secure the first and second electrical connectors to each other after the first and second engagement members have engaged each other.

7. The electrical connector assembly as recited in claim 6, wherein one of the first and second securement members is a latch member and the other of the first and second secure members is a catch member that interferes with the latch member with respect to the insertion direction so as to prevent movement of the second electrical connector with respect to the first electrical connector in a removal direction in an amount sufficient to detach the second electrical connector from the first electrical connector.

8. The electrical connector assembly as recited in claim 7, wherein at least one of the latch member and the catch member is deflectable so as to remove the interference between the catch member and the latch member.

9. The electrical connector assembly as recited in claim 1, wherein the electrical contacts of the third electrical connector are identical to each other.

10. An electrical connector subassembly comprising:

a first electrical connector including an electrically insulative first connector housing and a first plurality of electrical contacts supported by the first connector housing, wherein the first electrical connector is configured to be mounted onto a first electrical component of a first type; and a second electrical connector including an electrically insulative second connector housing and a second plurality of electrical contacts supported by the second connector housing, wherein the second electrical connector is configured to be mounted onto a second electrical component of a second type that is different than the first type, wherein the first electrical connector comprises a first guidance slot and a second guidance slot that is spaced a particular distance below the first guidance slot, the second electrical connector comprises a first guidance rail and a second guidance rail that is spaced a particular distance below the first guidance rail, and the first and second guidance rails are configured to be inserted in the first and second guidance slots along an insertion direction so as to attach the first and second electrical connectors to each other, and wherein the first and second electrical connectors are configured to be supported by each other via the guidance rails and the guidance slots prior to the first and second electrical connectors being mated with a third electrical connector.

11. The electrical connector subassembly as recited in claim 10, wherein the first and second electrical connectors are configured to mate with the third electrical connector along a mating direction when supported by each other, and the first and second guidance rails are configured to be inserted into the first and second guidance slots along the mating direction.

12. The electrical connector subassembly as recited in claim 10, wherein the first electrical connector is configured to be mounted onto a printed circuit board and the second electrical connector is configured to be mounted to a plurality of electrical cables.

13. The electrical connector subassembly as recited in claim 11, wherein the first electrical connector defines a stop surface configured to abut the housing of the second electrical connector so as to prevent further movement of the second electrical connector with respect to the first electrical connector along the mating direction.

14. The electrical connector subassembly as recited in claim 10, wherein each of the first, second, and third electrical connectors define respective mating interfaces, the mating interfaces of the first and second electrical connectors are configured to engage the mating interface of the third electrical connector when the electrical connector subassembly is mated to the third electrical connector, and the mating interfaces of the first and second electrical connectors are positioned side-by-side when the guidance slots and the guidance rails are fully engaged.

15. The electrical connector subassembly as recited in claim 14, wherein the mating interfaces of the first and second electrical connectors are coplanar with each other when the guidance slots and the guidance rails are fully engaged.

16. A method comprising:

supporting a first and a second electrical connector by each other without causing the first and second electrical connectors to mate with each other, wherein:

the first electrical connector includes a first connector housing and a first plurality of electrical contacts supported by the first connector housing, the first electrical connector configured to be mounted onto a first electrical component, and the second electrical connector includes a second connector housing and a second plurality of electrical contacts supported by the second connector housing, the second electrical connector configured to be mounted onto a second electrical component; and after the supporting step, simultaneously mating the first and second electrical connectors with a third electrical connector, wherein the third electrical connector includes a third connector housing and a third plurality of electrical contacts supported by the third connector housing, the third electrical connector configured to be mounted onto a third electrical component.

17. The method as recited in claim 16, wherein the first electrical component is of a first type and the second electrical component is of a second type that is different than the first type.

18. The method as recited in claim 16, wherein the mating step comprises bringing the first and second plurality of electrical contacts in to physical and electrical contact with the third plurality of electrical contacts of the third electrical connector.

19. The method as recited in claim 18, wherein the mating step occurs after the first and second electrical connectors are mounted onto the respective first and second electrical components.

20. The method as recited in claim 16, wherein each of the first and second electrical connectors define respective mating interfaces that are configured to engage the third electrical connector during the mating step, and the supporting step comprises placing the mating interfaces of the first and second electrical connectors side-by-side with each other.

21. The method as recited in claim 20, wherein the supporting step comprises placing the mating interfaces of the first and second electrical connectors in a coplanar relationship.

22. The method as recited in claim 16, wherein the mating step occurs along a mating direction, and the supporting step comprises moving one of the first and second electrical connectors with respect to the other of the first and second electrical connectors in the mating direction.

23. The method as recited in claim 22, wherein the supporting step comprises inserting at least one guidance rail of one of the first and second electrical connectors into at least one guidance slot of the other of the first and second electrical connectors along an insertion direction.

24. The method as recited in claim 16, further comprising the step of securing the first and second electrical connectors to each other so as to prevent removal of the first and second electrical connectors from the other of the first and second electrical connectors.

25. The method as recited in claim 24, wherein the securing step comprises placing respective securement members of the first and second electrical connectors in interference with each other after completion of the supporting step.

26. The method as recited in claim 25, further comprising the step of removing the securement members from interference with each other, and removing the first and second electrical connectors from each other.

27. The method as recited in claim 16, wherein the first electrical component comprises a printed circuit board.

28. The method as recited in claim 27, wherein the second electrical component comprises a plurality of electrical cables.

* * * * *